US010804654B1

(12) United States Patent
Chen et al.

(10) Patent No.: US 10,804,654 B1
(45) Date of Patent: Oct. 13, 2020

(54) ELECTRICAL CONNECTOR AND TRANSMISSION WAFER THEREOF

(71) Applicant: TOPCONN ELECTRONIC (KUNSHAN) CO., LTD., Suzhou, Jiangsu Province (CN)

(72) Inventors: Chih-Wei Chen, New Taipei (TW); Chung-Nan Pao, New Taipei (TW); Yueh-Lin Yang, New Taipei (TW); Yi-Guang Lai, New Taipei (TW); Guo-Cing Chen, New Taipei (TW); Kai Wu, Guangdong (CN)

(73) Assignee: TOPCONN ELECTRONIC (KUNSHAN) CO., LTD., Kunshan, Suzhou, Jiangsu Province (CN)

( * ) Notice: Subject to any disclaimer, the term of this patent is extended or adjusted under 35 U.S.C. 154(b) by 0 days.

(21) Appl. No.: 16/568,261

(22) Filed: Sep. 12, 2019

(30) Foreign Application Priority Data

May 7, 2019 (CN) ..... 2019 2 0645909 U

(51) Int. Cl.
*H01R 13/6587* (2011.01)
*H01R 13/506* (2006.01)
*H01R 13/518* (2006.01)

(52) U.S. Cl.
CPC ..... *H01R 13/6587* (2013.01); *H01R 13/506* (2013.01); *H01R 13/518* (2013.01)

(58) Field of Classification Search
CPC ..... H01R 13/506; H01R 13/518; H01R 13/6471; H01R 13/6587; H01R 13/6585
See application file for complete search history.

(56) References Cited

U.S. PATENT DOCUMENTS 4,956,604 A * 9/1990 Cedrone ..... G01R 1/0433 324/754.07
6,960,103 B2 * 11/2005 Tokunaga ..... H01R 31/06 439/607.13
7,811,128 B2 * 10/2010 Pan ..... H01R 23/688 439/607.05
8,366,485 B2 * 2/2013 Johnescu ..... H01R 13/6587 439/607.07
8,888,530 B2 * 11/2014 Trout ..... H01R 13/6587 439/607.07
9,634,434 B1 * 4/2017 Pao ..... H01R 13/6471
9,660,384 B2 * 5/2017 Paniagua ..... H01R 12/737
9,660,399 B2 * 5/2017 Hsu ..... H01R 24/60
(Continued)

*Primary Examiner* — Briggitte R. Hammond
(74) *Attorney, Agent, or Firm* — Li & Cai Intellectual Property Office

(57) ABSTRACT

An electrical connector and a transmission wafer thereof are provided. The transmission wafer includes an insulating frame, a plurality of grounding terminals fixed to the insulating frame, and a shielding member disposed on the insulating frame. Each of the grounding terminals includes a middle grounding segment embedded in the insulating frame, a front grounding segment, and a rear grounding segment, the latter two of which respectively extend from two ends of the middle grounding segment in two different directions. The shielding member includes a grounding sheet disposed on the insulating frame and a plurality of elastic arms curvedly extending from the grounding sheet to protrude from the insulating frame. The elastic arms are respectively abutted against portions of the front grounding segments arranged adjacent to the insulating frame.

11 Claims, 15 Drawing Sheets

(56) References Cited

U.S. PATENT DOCUMENTS

| | | | | |
|---|---|---|---|---|
| 2013/0017725 | A1* | 1/2013 | Davis | H01R 13/6587 439/607.55 |
| 2014/0194004 | A1* | 7/2014 | Pickel | H01R 13/648 439/607.01 |
| 2015/0236451 | A1* | 8/2015 | Cartier, Jr. | H01R 13/6599 439/607.05 |
| 2016/0134057 | A1* | 5/2016 | Buck | H01R 13/6471 439/607.05 |

* cited by examiner

ELECTRICAL CONNECTOR AND TRANSMISSION WAFER THEREOF

CROSS-REFERENCE TO RELATED PATENT APPLICATION

This application claims the benefit of priority to China Patent Application No. 201920645909.0, filed on May 7, 2019 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to an electrical connector and a transmission wafer thereof each having at least one shielding member.

BACKGROUND OF THE DISCLOSURE

A conventional transmission wafer of connector includes an insulating sheet, a plurality of conductive terminals fixed to the insulating sheet, and a shielding member disposed on the insulating sheet. However, the shielding member of the conventional transmission wafer is not in contact with at least one grounding terminal of the conductive terminals, or the shielding member is only in contact with a portion of the grounding terminal fixed in the insulating sheet. Accordingly, when the conventional connector and a mating connector are assembled with each other so as to have a contacting area thereof that easily produces interference, noise from the contacting area cannot be effectively decreased, which means the common ground effect of the conventional connector is incomplete, and crosstalk of the conventional connector is difficult to be improved.

SUMMARY OF THE DISCLOSURE

In response to the above-referenced technical inadequacies, the present disclosure provides an electrical connector and a transmission wafer thereof to effectively improve the issues associated with conventional transmission wafers (or conventional connectors).

In one aspect, the present disclosure provides a transmission wafer of an electrical connector. The transmission wafer includes an insulating frame, a plurality of grounding terminals fixed to the insulating frame, and a shielding member disposed on the insulating frame. Each of the grounding terminals includes a middle grounding segment embedded in the insulating frame, a front grounding segment, and a rear grounding segment, the latter two of which respectively extend from two ends of the middle grounding segment in two different directions. The shielding member includes a grounding sheet disposed on the insulating frame and a plurality of elastic arms curvedly extending from the grounding sheet to protrude from the insulating frame. The elastic arms are respectively abutted against portions of the front grounding segments arranged adjacent to the insulating frame.

In one aspect, the present disclosure provides an electrical connector, which includes a housing and a plurality of the transmission wafers. The transmission wafers are stacked in one pile and inserted into the housing.

Therefore, the transmission wafer or the electrical connector provided by the present disclosure uses the elastic arms of the shielding member to abut against the front grounding segments of the grounding terminals, so that the shielding member can be able to effectively guide noise generated from the front grounding segments and can be in stable electrical connection with each of the grounding terminals, improving the common ground performance and the crosstalk of the electrical connector (or the transmission wafer) of the present disclosure.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
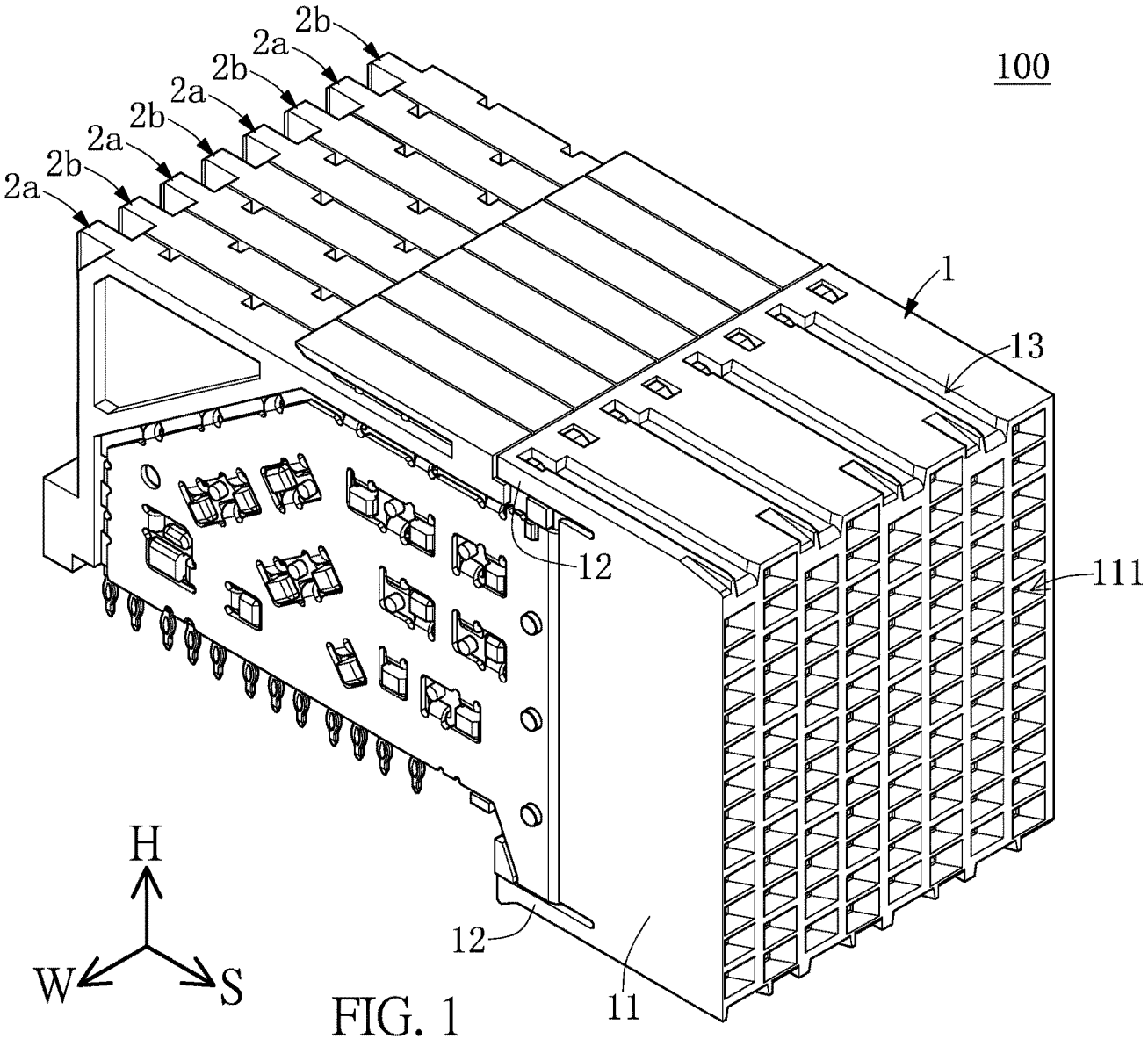
FIG. 1 is a perspective view of an electrical connector according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 11, a first embodiment of the present disclosure provides an electrical connector 100 that can be a high speed (or high frequency) connector applied to a server or a switchboard, but the present disclosure is not limited thereto. The electrical connector 100 is configured to detachably insert into a mating connector (not shown) along an insertion direction S. In order to describe the present embodiment, the electrical connector 100 further defines a width direction W and a height direction H both perpendicular to each other and perpendicular to the insertion direction S.

Figure 2:
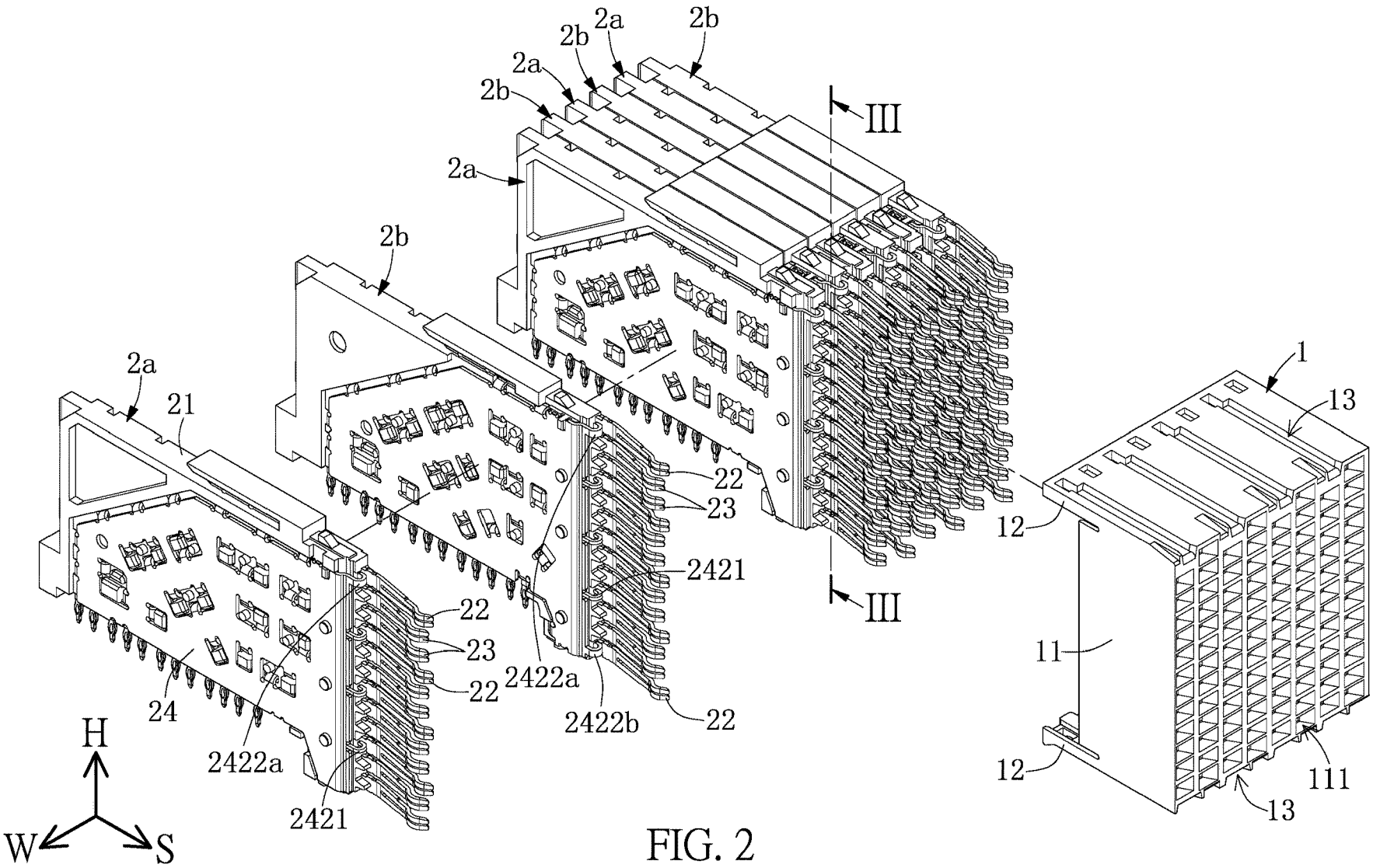
FIG. 2 is an exploded view of FIG. 1.
Figure 3:
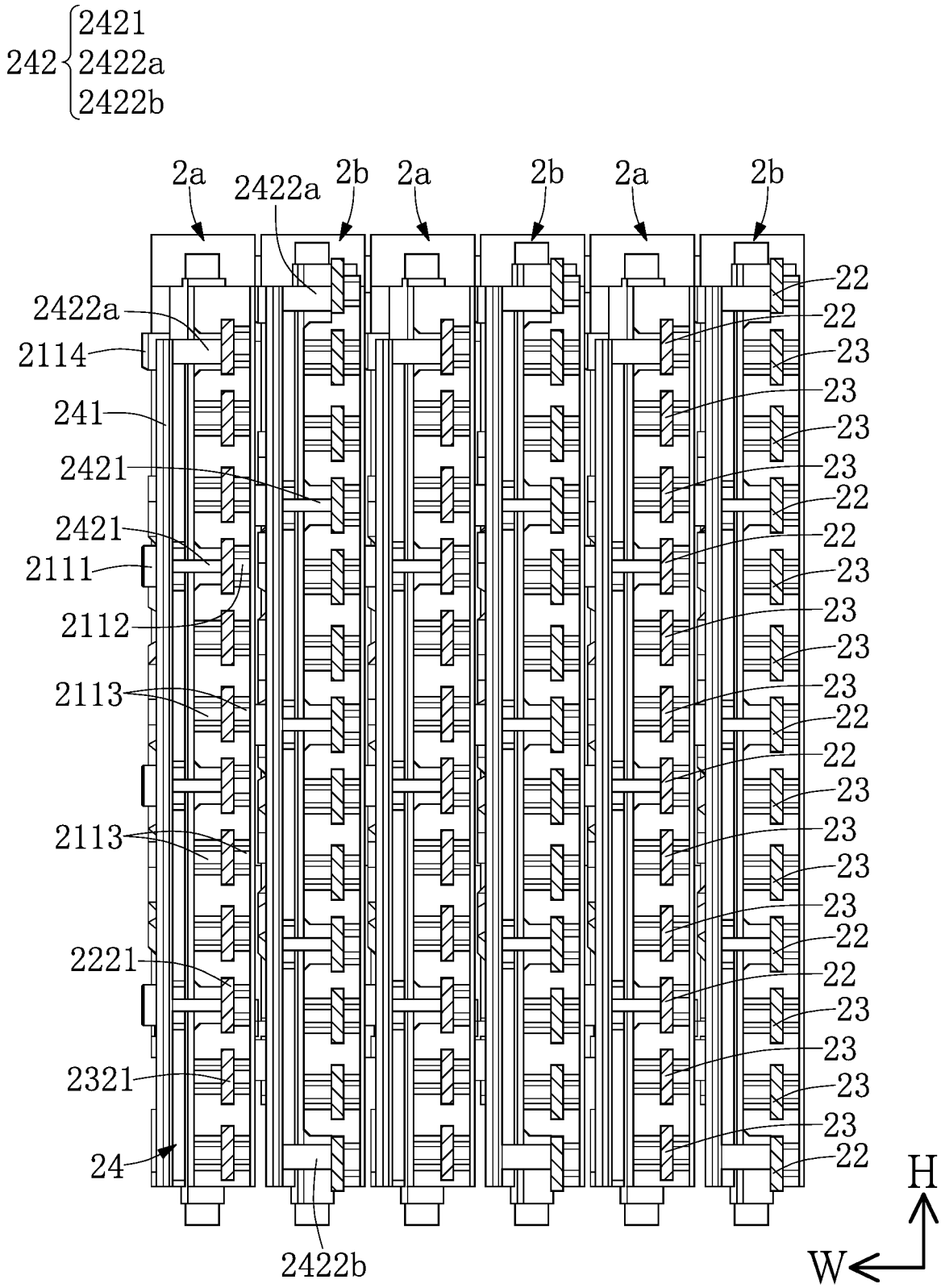
FIG. 3 is a cross-sectional view taken along line III-III of FIG. 2.

As shown in FIG. 1 to FIG. 3, the electrical connector 100 includes a housing 1 and a plurality of transmission wafers 2*a*, 2*b* inserted into the housing 1. The transmission wafers 2*a*, 2*b* in the present embodiment are stacked in one pile along the width direction W. In addition, each of the transmission wafers 2*a*, 2*b* in the present embodiment is in cooperation with the housing 1, but each of the transmission wafers 2*a*, 2*b* can be independently applied alone or can be applied to other components in other embodiments of the present disclosure.

As shown in FIG. 1 and FIG. 2, the housing 1 includes an insertion portion 11 substantially being a cuboid, two positioning boards 12 extending from a top end and a bottom end of the insertion portion 11 along the insertion direction S, and a plurality of guiding grooves 13 respectively recessed in a top surface and a bottom surface of the insertion portion 11. The insertion portion 11 has a plurality of terminal holes 111 penetratingly recessed in a front surface thereof and arranged in a plurality of rows, and each of the rows of the terminal holes 111 corresponds in position to one of the transmission wafers 2*a*, 2*b*. In other words, each of the rows of the terminal holes 111 is arranged by paralleling to the height direction H.

As shown in FIG. 2, the transmission wafers 2*a*, 2*b* are inserted into the insertion portion 11 of the housing 1, and are engaged with the two positioning boards 12 of the housing 1. The transmission wafers 2*a*, 2*b* of the electrical connector 100 includes two different structures that are stacked in a staggered arrangement. The two different structures of the transmission wafers 2*a*, 2*b* in the present embodiment are similar, so that the following description describes the common features of the two different structures that approximately describe the entirety structure of the transmission wafer 2*a*, and then describes the different features of the two different structures for the sake of brevity. However, in other embodiments of the present disclosure, the transmission wafers of the electrical connector 100 can be the same, or can have at least three different structures. Moreover, the staggered arrangement of the transmission wafers 2*a*, 2*b* is not limited to the two different structures stacked one by one.

As shown in FIG. 4 to FIG. 7, the transmission wafer 2*a* of the present embodiment includes an insulating frame 21, a plurality of grounding terminals 22 fixed to the insulating frame 21, a plurality of signal terminals 23 fixed to the insulating frame 21, and a shielding member 24 disposed on one side of the insulating frame 21. Any two of the grounding terminals 22 adjacent to each other are provided with two of the signal terminals 23 there-between that can be used to jointly transmit differential signals. The shielding member 24 is arranged at one side of the grounding terminals 22 and the signal terminals 23.

It should be noted that the number of the terminals of one of the two different structures of the transmission wafers 2*a*, 2*b* is more than that of the other one of the two different structures of the transmission wafers 2*a*, 2*b* by one. Specifically, the number of the grounding terminals 22 of the transmission wafer 2*b* (shown in FIG. 8 to FIG. 11) is more than that of the transmission wafer 2*a* (shown in FIG. 4 to FIG. 7) by one. Projection regions defined by projecting the terminals of the transmission wafer 2*a* onto the transmission wafer 2*b* along the width direction W are presented in staggered arrangement.

The insulating frame 21 includes a front end portion 211, a rear end portion 212, a top end portion 213, and a bottom end portion 214, which are arranged on a periphery part thereof and each have an elongated shape. A longitudinal direction of the front end portion 211 and a longitudinal direction of the rear end portion 212 are substantially parallel to the height direction H, and a longitudinal direction of the top end portion 213 and a longitudinal direction of the bottom end portion 214 are substantially parallel to the insertion direction S. In other words, the longitudinal direction of the front end portion 211 is substantially perpendicular to that of the bottom end portion 214.

Two opposite ends of the front end portion 211 of the insulating frame 21 (e.g., a top end and a bottom end of the front end portion 211) are engaged with the two positioning boards 12, respectively. The insulating frame 21 includes a plurality of rivets 2111 passing through and fixed onto the shielding member 24, so that a force generated from the inserting of the electrical connector 100 and applied to the shielding member 24 can be resisted by the cooperation of the rivets 2111 and the shielding member 24, preventing the shielding member 24 from being bent. The rivets 2111 are preferably arranged on the same side surface of the insulating frame 21 (that carries the shielding member 24) along the height direction H, and are preferably arranged adjacent to (or arranged on) the front end portion 211.

Moreover, the insulating frame 21 includes a plurality of grounding supports 2112 respectively corresponding in position to the grounding terminals 22 and a plurality pairs of signal supports 2113 respectively corresponding in position to the signal terminals 23. The grounding supports 2112 and the signal supports 2113 are preferably arranged on a front part of the front end portion 211. The grounding supports 2112 and one of the two signal supports 2113 in each pair are arranged in one row along the height direction H, and the other one of the two signal supports in each pair are arranged in another row along the height direction H. The two signal supports 2113 in each pair face each other along the width direction W.

Figure 4:
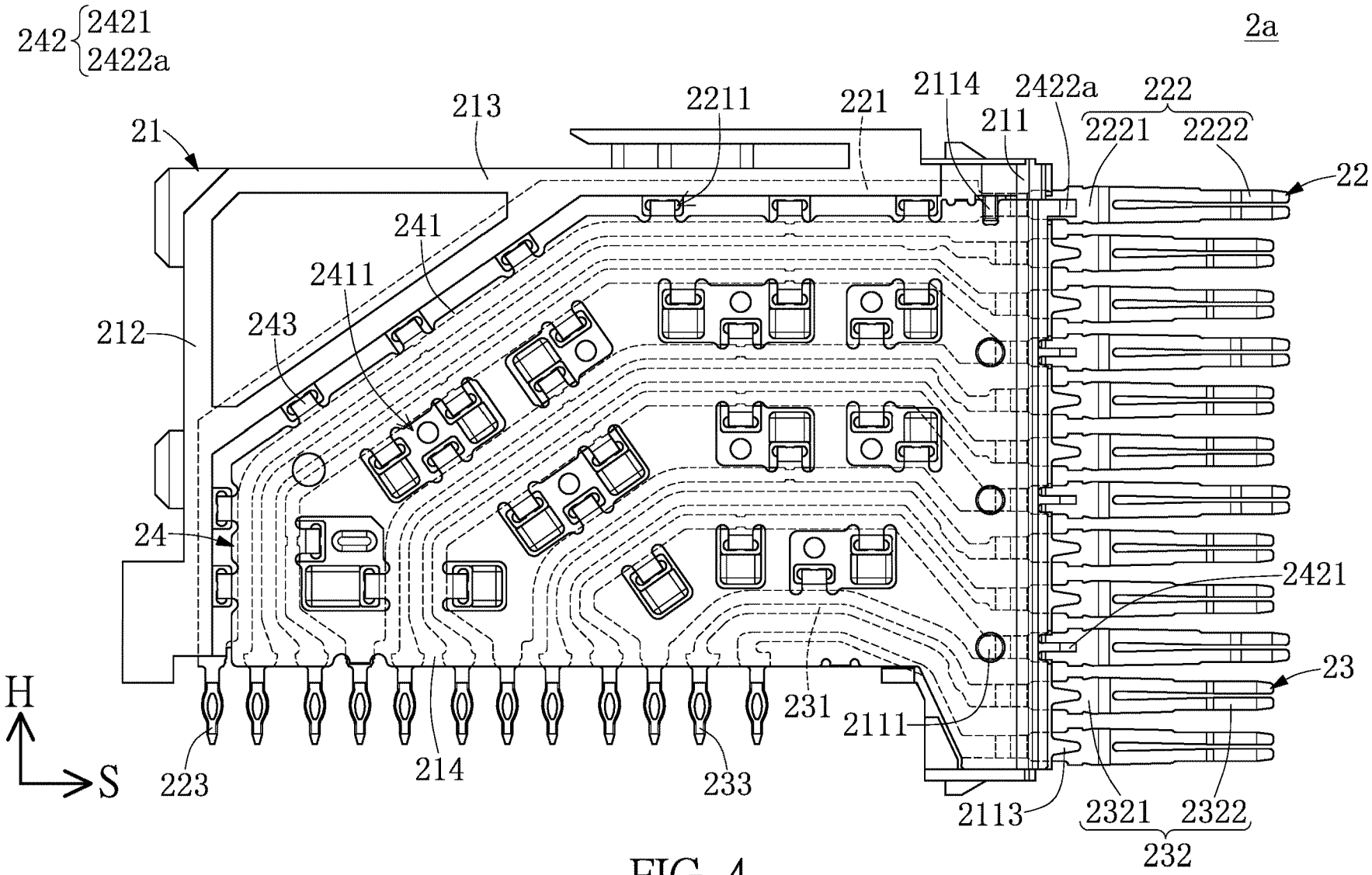
FIG. 4 is a planar view showing a first transmission wafer counted from the left side of FIG. 2.
Figure 5A:
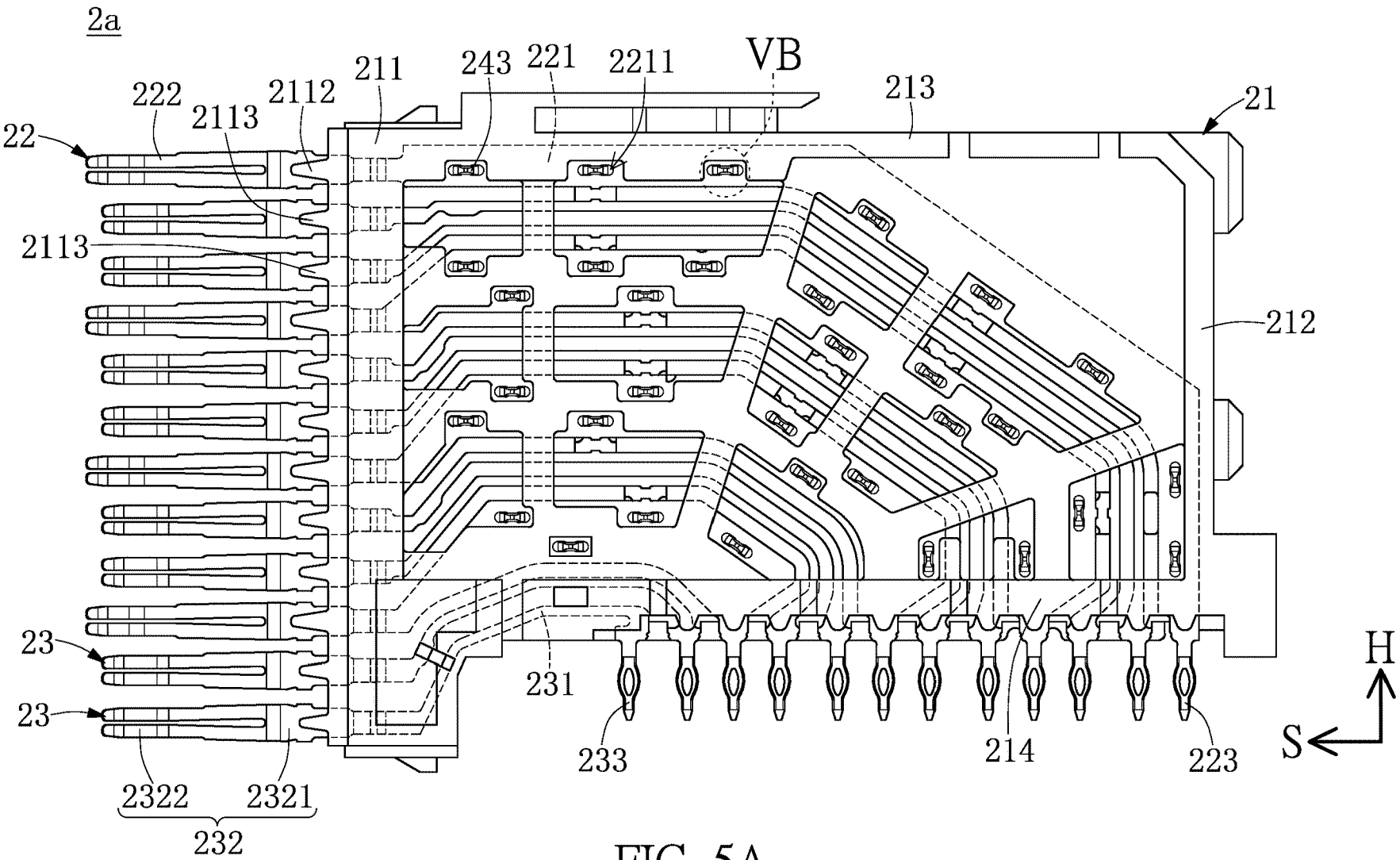
FIG. 5A is a planar view of FIG. 4 in another angle of view.
Figure 5B:
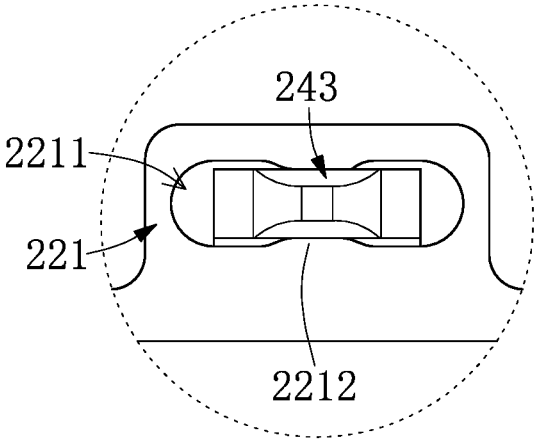
FIG. 5B is an enlarged view of portion VB of FIG. 5A.
Figure 6:
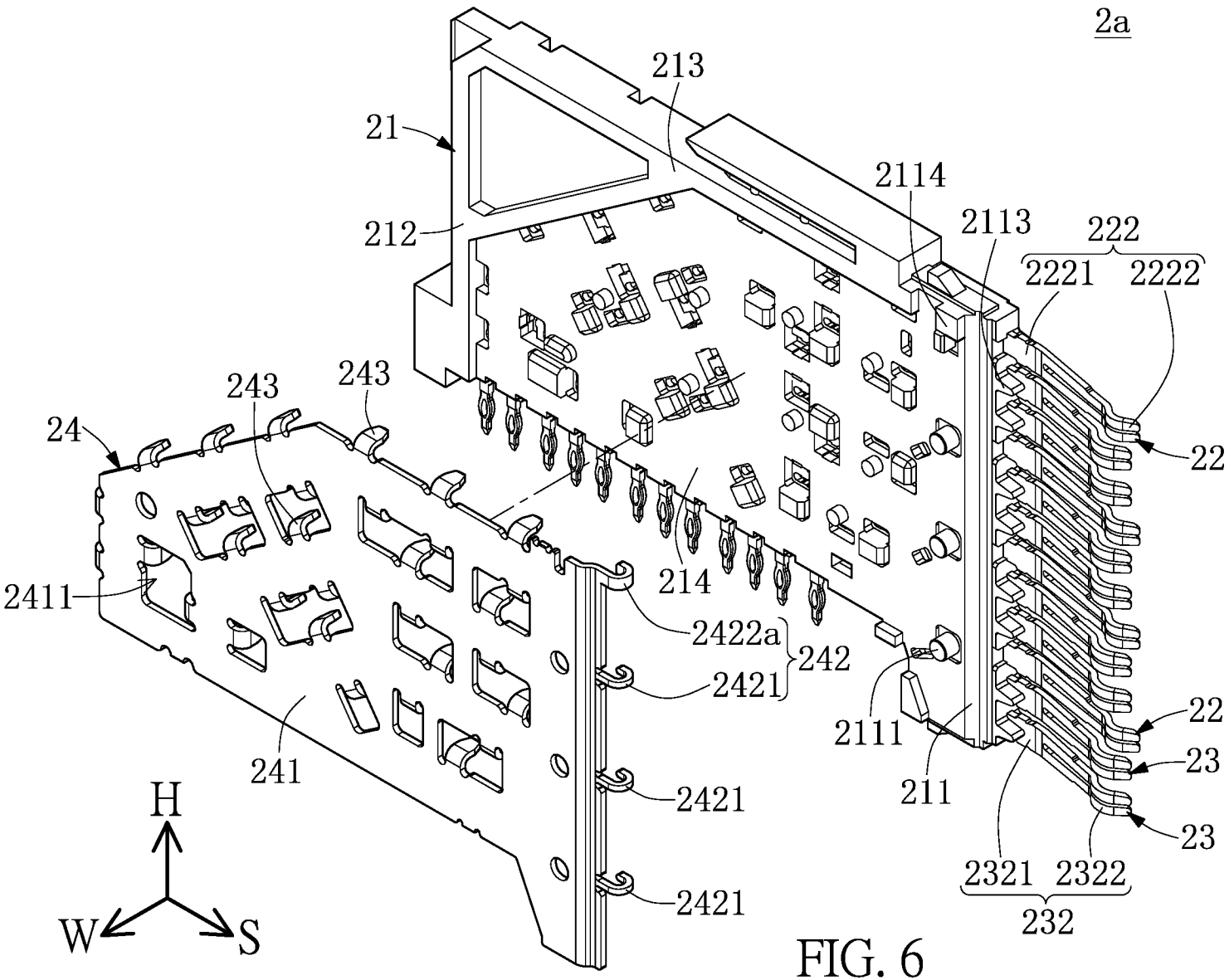
FIG. 6 is an exploded view showing the first transmission wafer counted from the left side of FIG. 2.
Figure 7:
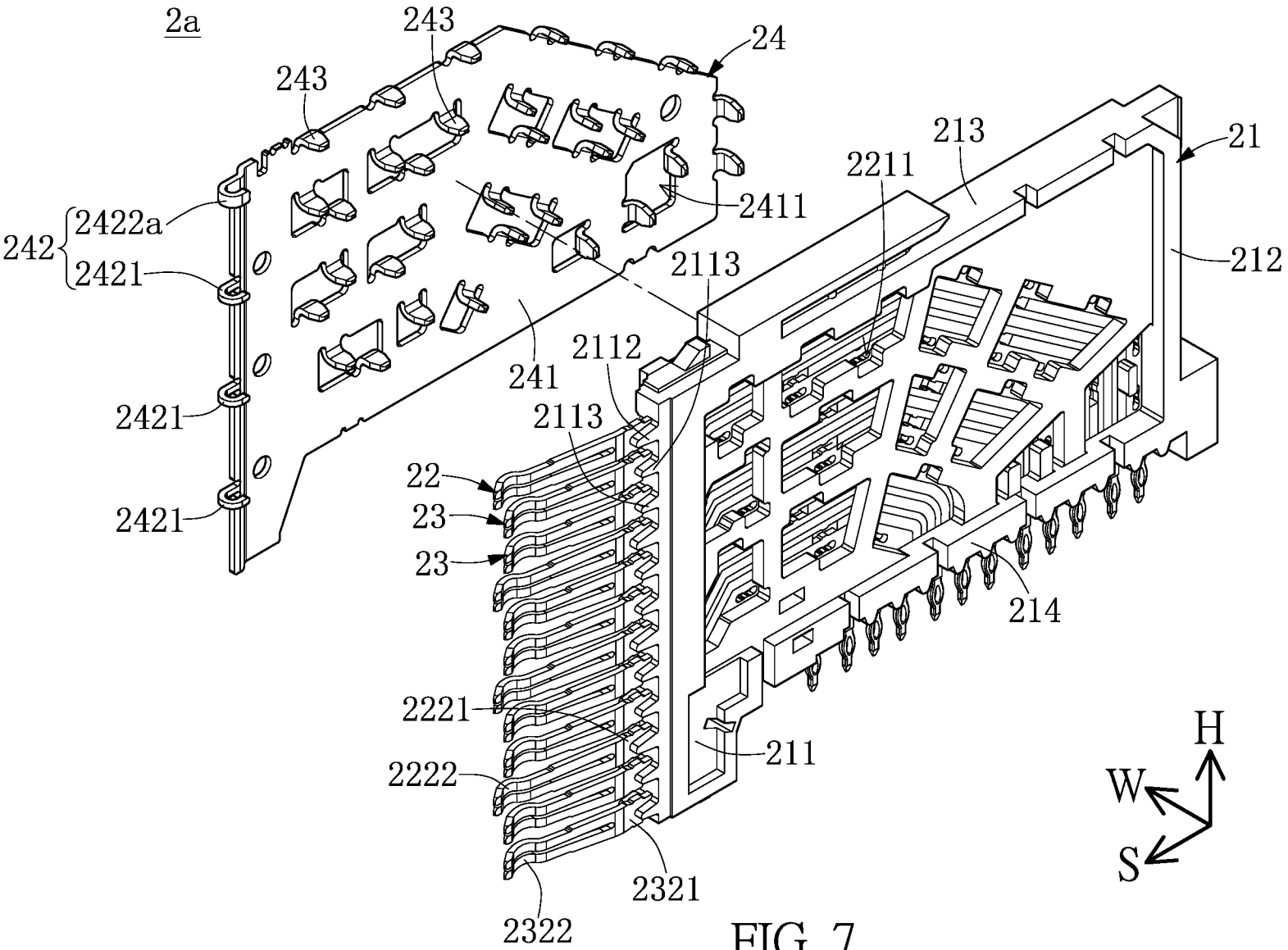
FIG. 7 is an exploded view of FIG. 6 in another angle of view.
Figure 8:
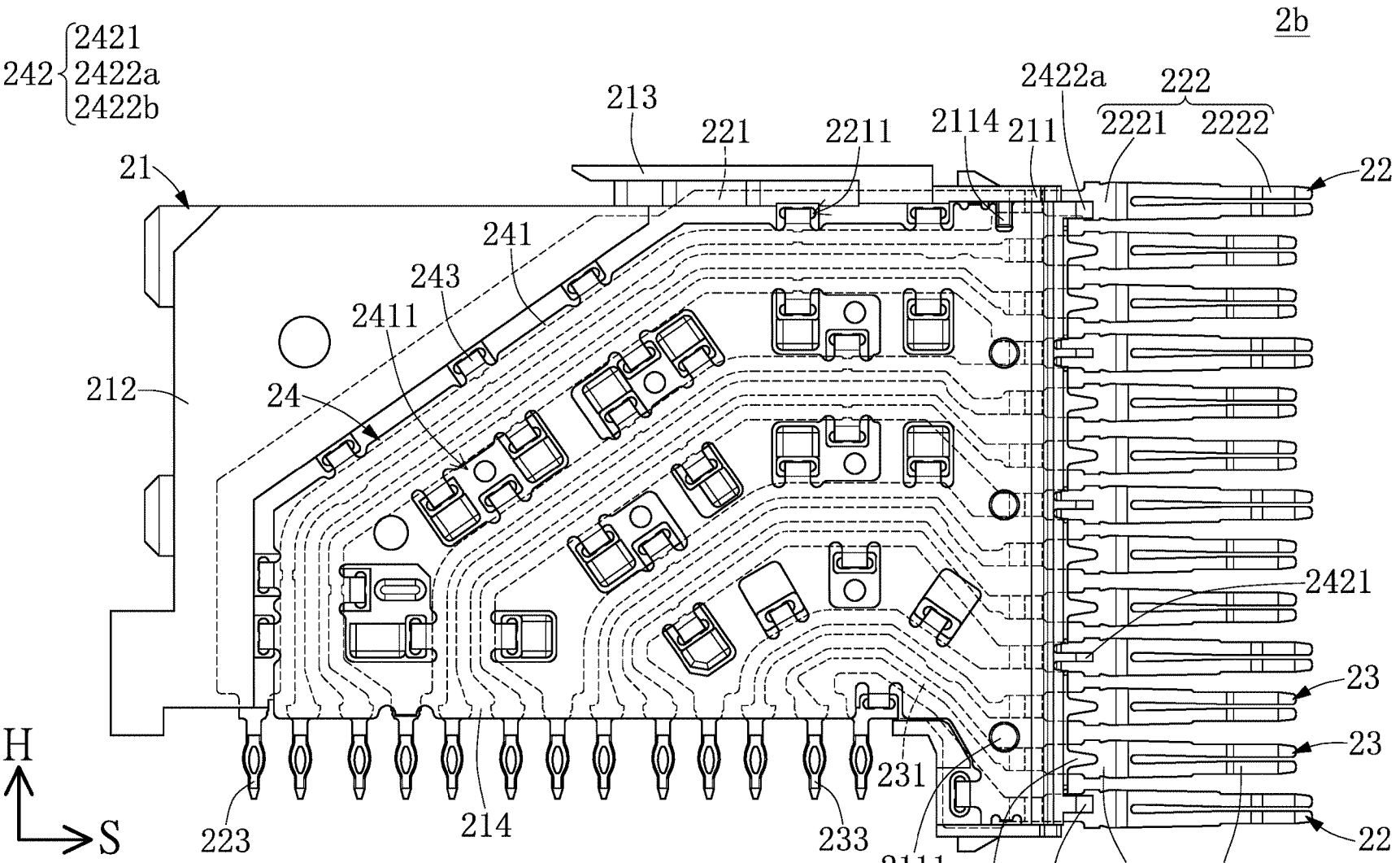
FIG. 8 is a planar view showing a second transmission wafer counted from the left side of FIG. 2.
Figure 9:
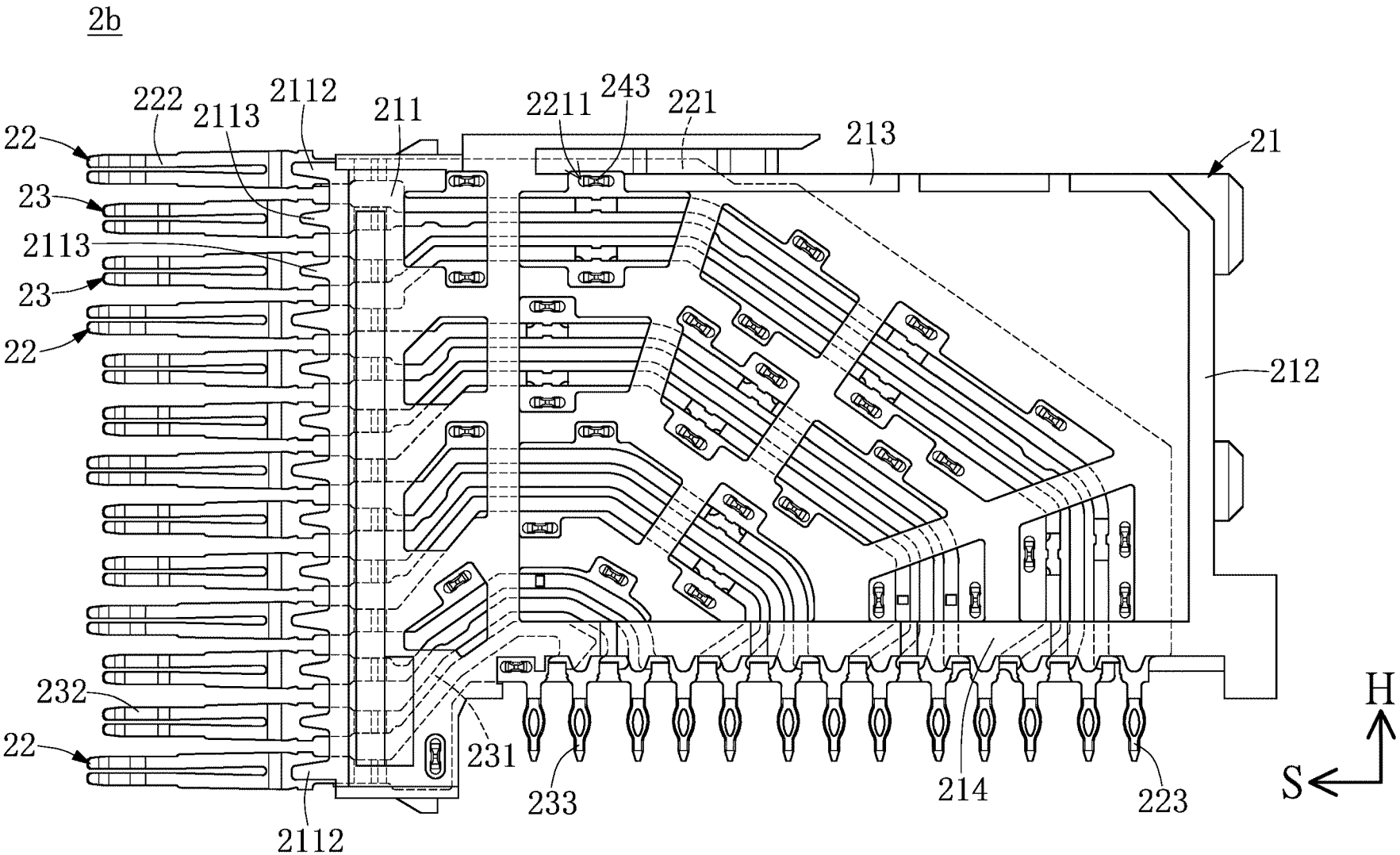
FIG. 9 is a planar view of FIG. 8 in another angle of view.
Figure 10:
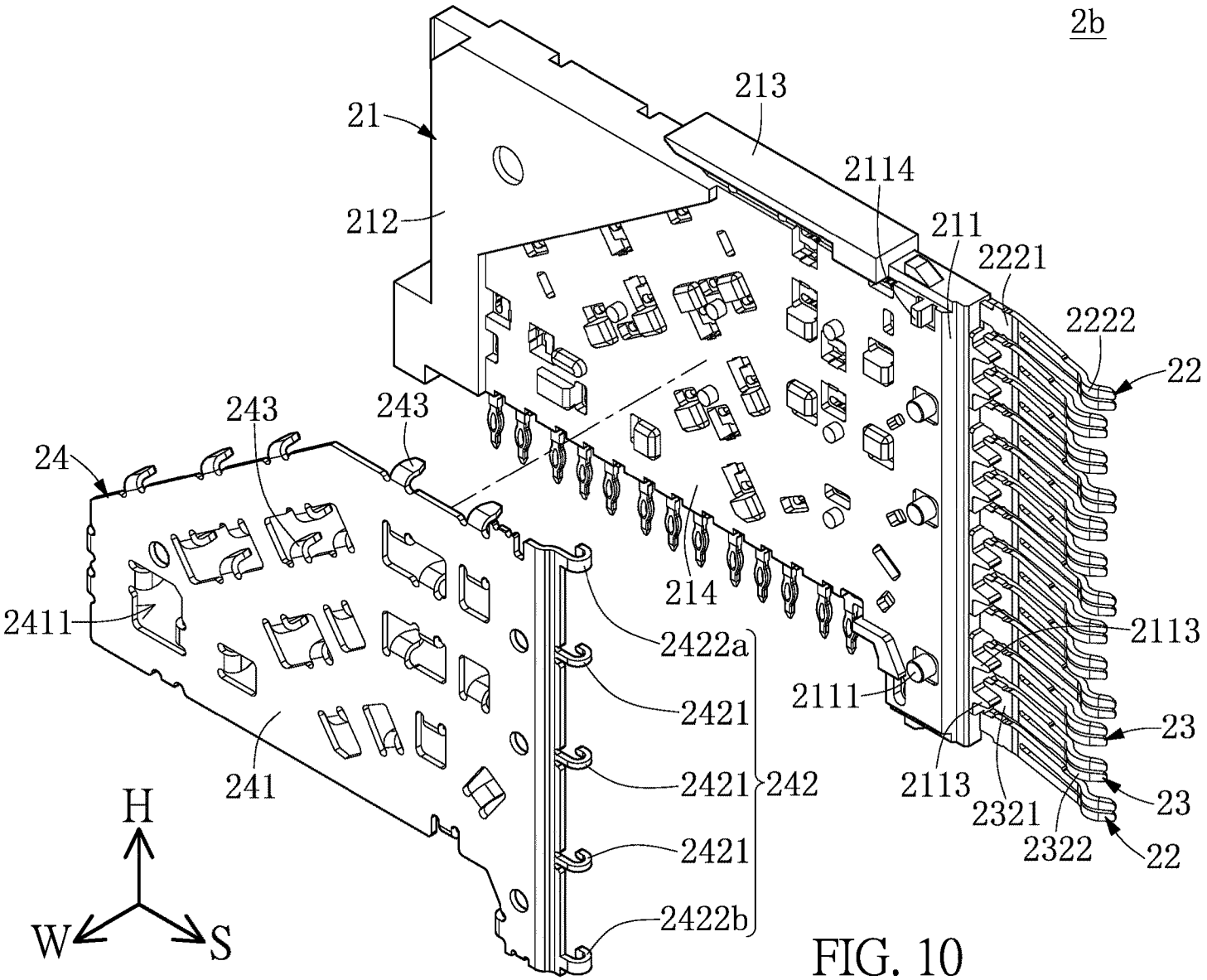
FIG. 10 is an exploded view showing the second transmission wafer counted from the left side of FIG. 2.
Figure 11:
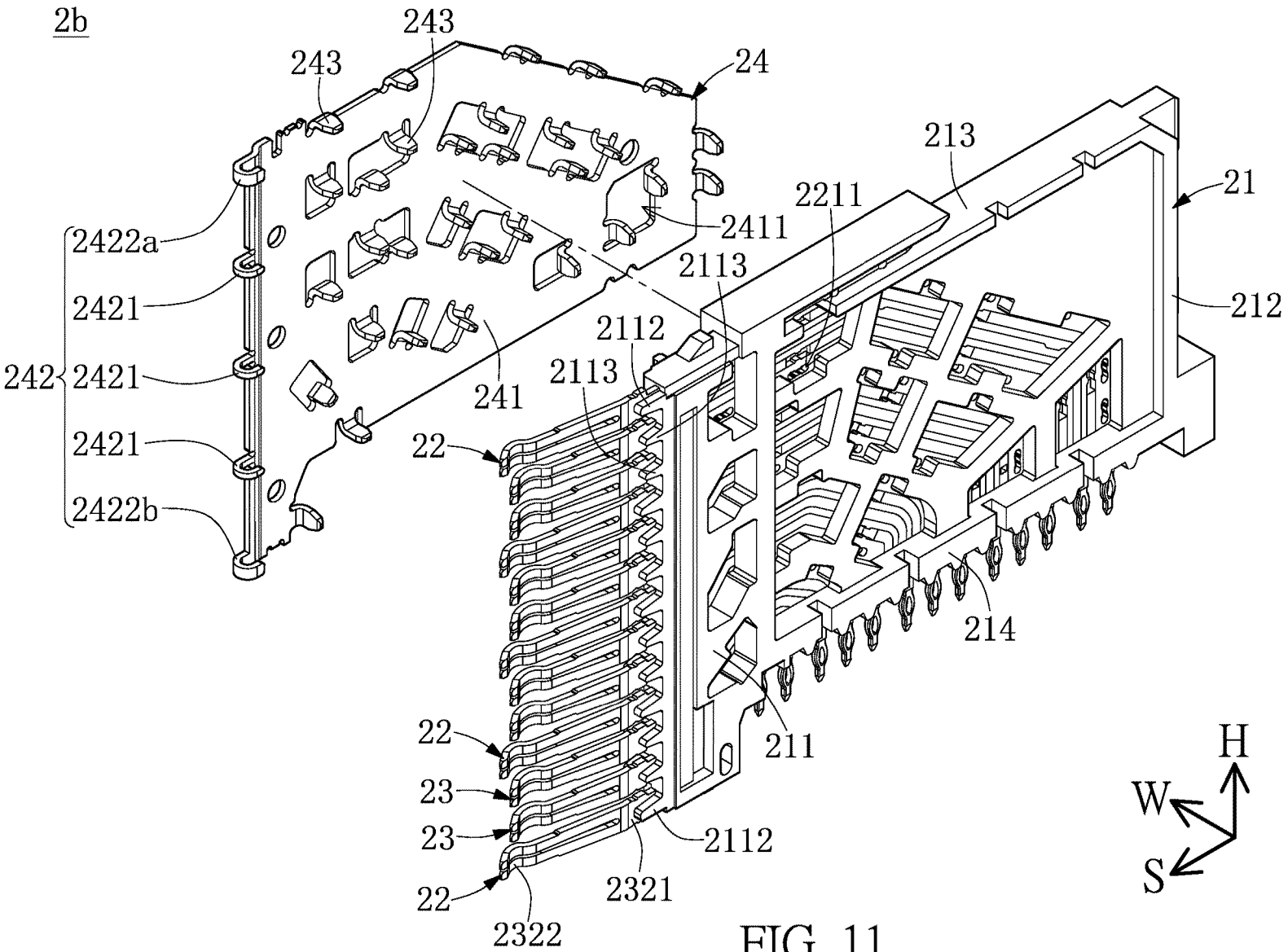
FIG. 11 is an exploded view of FIG. 10 in another angle of view.

As shown in FIG. 4 and FIG. 5, each of the grounding terminals 22 is integrally formed as a one-piece structure, and includes a middle grounding segment 221 embedded in the insulating frame 21, a front grounding segment 222 extending from one end of the middle grounding segment 221 to protrude from the front end portion 211, and a rear grounding segment 223 extending from another end of the middle grounding segment 221 to protrude from the bottom end portion 214. In other words, the front grounding segment 222 and the rear grounding segment 223 respectively extend from two opposite ends of the middle grounding segment 221 in two different directions and are perpendicular to one another, but the present disclosure is not limited thereto.

Specifically, the middle grounding segment 221 of each of the grounding terminals 22 has a plurality of thru-holes 2211 spaced apart from each other. Each of the thru-holes 2211 is defined by an inner wall that has two protrusions 2212 facing each other and preferably arranged on a center part thereof. In other words, the inner wall defining the thru-hole 2211 in the present embodiment is substantially in a doggy bone shape, but the present disclosure is not limited thereto.

In each of the grounding terminals 22, the front grounding segment 222 is a cantilever structure, and includes a base portion 2221 extending from the middle grounding segment 221 and two contacting portions 2222 extending from the base portion 2221 in a direction away from the insulating frame 21. The two contacting portions 2222 of each of the grounding terminals 22 have substantially the same structure and are parallel to each other. However, in other embodiments of the present disclosure, the front grounding segment 222 can include at least one contacting portion 2222 extending from the base portion 2221.

As shown in FIG. 4 and FIG. 5A, each of the signal terminals 23 is integrally formed as a one-piece structure, and includes a middle signal segment 231 embedded in the insulating frame 21, a front signal segment 232 extending from one end of the middle signal segment 231 to protrude from the front end portion 211, and a rear signal segment 233 extending from another end of the middle signal segment 231 to protrude from the bottom end portion 214. In other words, the front signal segment 232 and the rear signal segment 233 respectively extend from two opposite ends of the middle signal segment 231 in two different directions and are perpendicular to one another, but the present disclosure is not limited thereto.

In each of the signal terminals 23, the front signal segment 232 is a cantilever structure, and includes a base portion 2321 extending from the middle signal segment 231 and two contacting portions 2322 extending from the base portion 2321 in a direction away from the insulating frame 21. The two contacting portions 2322 of each of the signal terminals 23 have substantially the same structure and are parallel to each other. Moreover, each pair of the signal supports 2113 of the insulating frame 21 sandwiches a portion (i.e., the base portion 2321) of one of the front signal segments 232 arranged adjacent the insulating frame 21.

In addition, the front grounding segment 222 of each of the grounding terminals 22 extends beyond the front signal segment 232 of any one of the signal terminals 23. When the electrical connector 100 is inserted into a mating connector (not shown), the contacting portions 2222 of each of the front grounding segments 222 are configured to be applied with a force so as to move along a first direction, and the contacting portions 2322 of each of the front signal segments 232 are configured to be applied with a force so as to move along a second direction parallel to the first direction. Moreover, the front grounding segments 222 and the front signal segments 232 of each of the transmission wafers 2*a*, 2*b* are inserted into one of the rows of the terminal holes 111.

As shown in FIG. 4 to FIG. 7, the shielding member 24 in the present embodiment is integrally formed as a one-piece structure and is formed by punching and bending a metal sheet. The shielding member 24 includes a grounding sheet 241 disposed on a side surface of the insulating frame 21, a plurality of elastic arms 242 extending from the grounding sheet 241 to protrude from the front end portion 211 of the insulating frame 21, and a plurality of internally connecting arms 243 curvedly extending from the grounding sheet 241.

The elastic arms 242 extend from a front edge of the grounding sheet 241, and respectively corresponding in position to the grounding supports 2112 of the insulating frame 21. The elastic arms 242 of the shielding member 24 are respectively abutted against portions (e.g., the base portions 2221) of the front grounding segments 222 arranged adjacent to the insulating frame 21. Moreover, each of the elastic arms 242 and the corresponding grounding support 2112 in the present embodiment sandwich the base portion 2221 of one of the front grounding segments 222, but the present disclosure is not limited thereto.

Specifically, any one of the elastic arms 242 extends from the grounding sheet 241 toward the base portion 2221 of the corresponding front grounding segment 222 by being once bent. Any one of the elastic arms 242 in the present embodiment is substantially in a U-shape or a J-shape. The elastic arms 242 of the shielding member 24 include a plurality of narrow elastic arms 2421 and a broad elastic arm 2422*a* that is arranged at one side of the narrow elastic arms 2421. Moreover, the broad elastic arm 2422*a* is arranged further away from the rear grounding segments 223 than each of the narrow elastic arms 2421.

The insulating frame 21 includes a positioning block 2114 engaged with the grounding sheet 241 of the shielding member 24, and the positioning block 2114 in the present embodiment is arranged on the front end portion 211 and adjacent to the broad elastic arm 2422*a*. In addition, at least two of the rivets 2111 of the insulating frame 21 are arranged adjacent to at least two of the narrow elastic arms 2421, respectively. Specifically, in the transmission wafer 2*a* shown in FIG. 4, the rivets 2111 of the insulating frame 21 are arranged adjacent to the narrow elastic arms 2421 of the shielding member 24, respectively.

As shown in FIG. 3, in two of the transmission wafers 2*a*, 2*b* adjacent to each other (i.e., the two adjacent transmission wafers 2*a*, 2*b* having different structures), the two broad elastic arms 2422*a* are staggered one another along the height direction H. In addition, comparing to the transmission wafer 2*a* (shown in FIG. 4 to FIG. 7), the transmission wafer 2*b* (shown in FIG. 8 to FIG. 10) further includes a broad elastic arm 2422*b*. In the transmission wafer 2*b*, the two broad elastic arms 2422*a*, 2422*b* are arranged at two opposite sides of the narrow elastic arms 2421.

The grounding sheet 241 has a plurality of openings 2411. The internally connecting arms 243 substantially and perpendicularly extend from edges of the grounding sheet 241 and inner walls defined by the openings 2411, respectively. The shielding member 24 uses the internally connecting arms 243 to respectively insert into and fix onto the thru-holes 2211 of the grounding terminals 22, and each of the internally connecting arms 243 is clamped between the two protrusions 2212 of the corresponding thru-hole 2211, so that the shielding member 124 can be electrically connected to each of the grounding terminals 22.

In other embodiments of the present disclosure, the middle grounding segment 221 of at least one of the grounding terminals 22 can be formed with a plurality of thru-holes 2211 spaced apart from each other, and an inner wall defining one of the thru-holes 2211 can be have two protrusions 2212 facing each other. Moreover, the shielding member 24 includes a plurality of internally connecting arms 243 respectively passing through the thru-holes 2211, and at least one of the internally connecting arms 243 is clamped between the two protrusions 2212.

Second Embodiment

Figure 12:
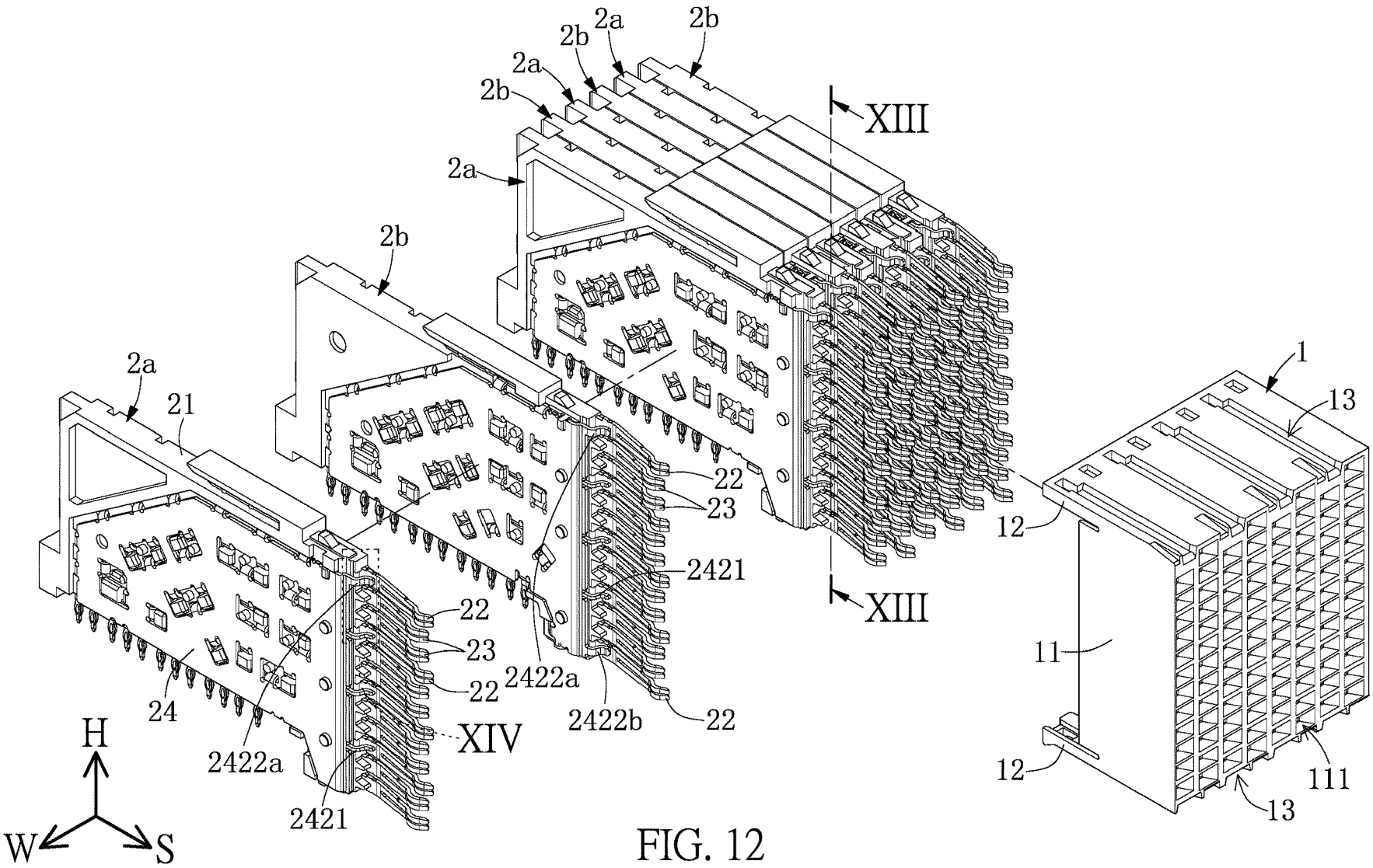
FIG. 12 is an exploded view of an electrical connector according to a second embodiment of the present disclosure.
Figure 13:
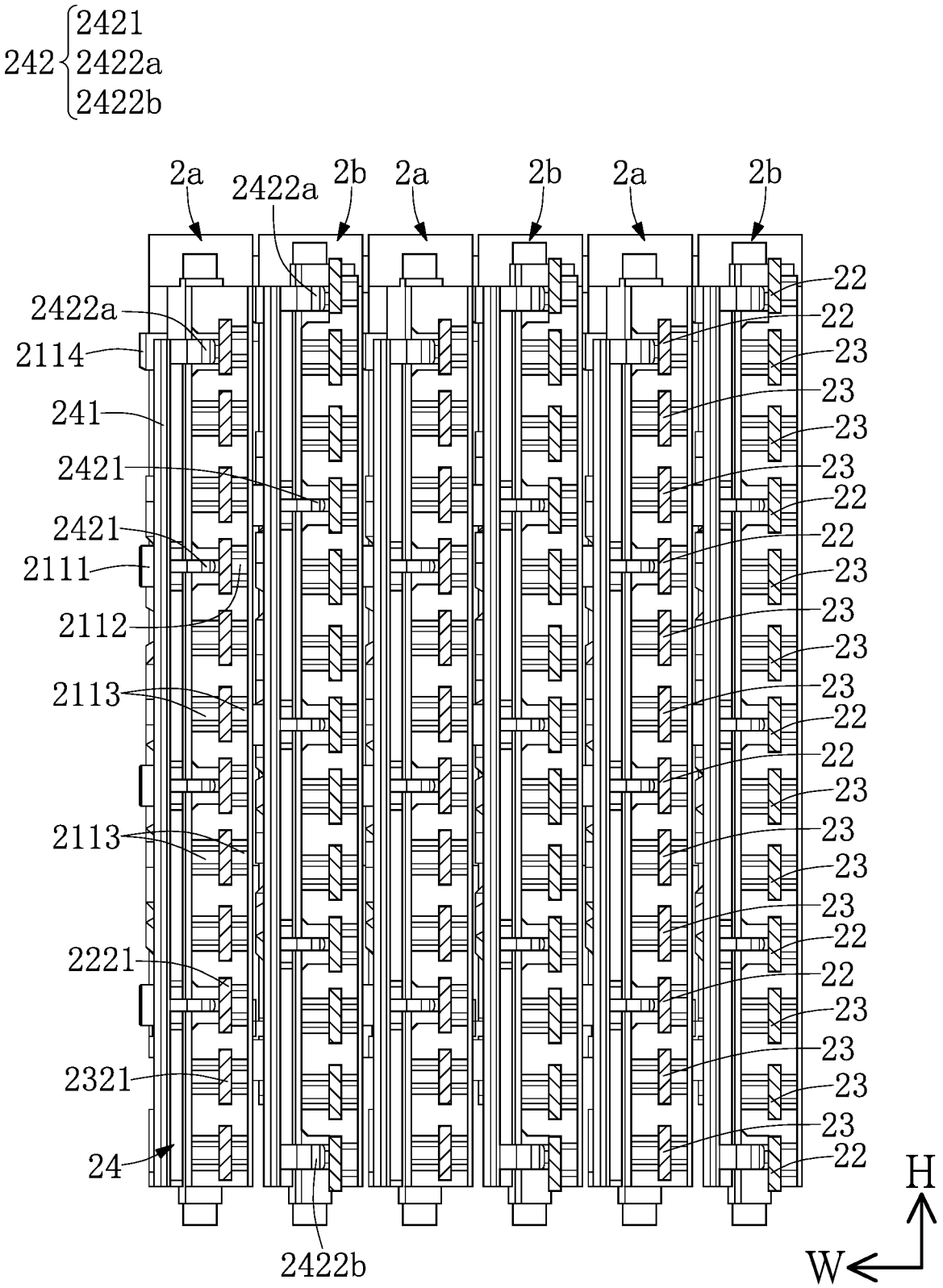
FIG. 13 is a cross-sectional view taken along line XIII-XIII of FIG. 12.
Figure 14:
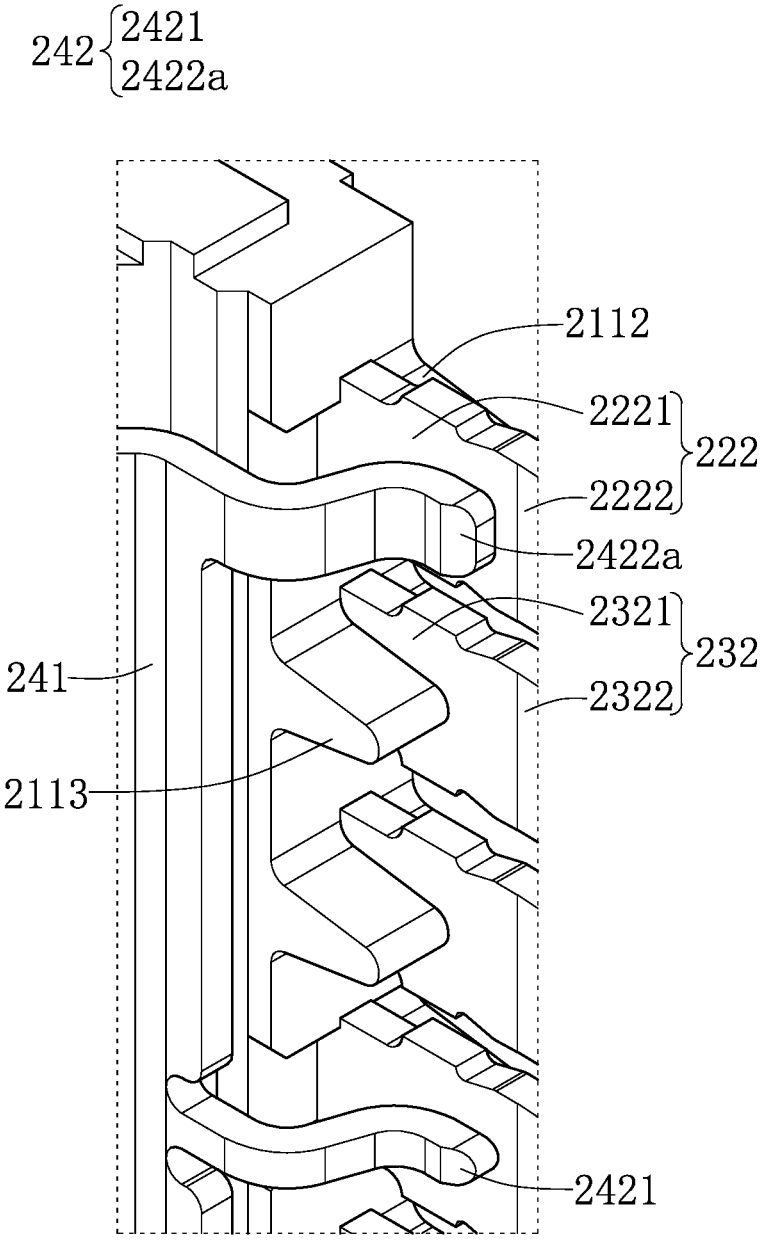
FIG. 14 is an enlarged view of portion XIV of FIG. 12.

Referring to FIG. 12 and FIG. 14, a second embodiment of the present disclosure is similar to the first embodiment of the present disclosure, so that the descriptions of the same components in the first and second embodiments of the present disclosure will be omitted for the sake of brevity, and the following description only discloses different features between the first and second embodiments.

In any one of the transmission wafers 2*a*, 2*b* of the present embodiment, any one of the elastic arms 242 extends from the grounding sheet 241 toward the base portion 2221 of the corresponding front grounding segment 222 by being twice bent respectively in two opposite directions. In other words, any one of the elastic arms 242 of the present embodiment can be substantially in a Z-shape.

In conclusion, the transmission wafer or the electrical connector provided by the present disclosure uses the elastic arms of the shielding member to abut against the front grounding segments of the grounding terminals, so that the shielding member can be able to effectively guide noise generated from the front grounding segments and can be stable to electrically connect to each of the grounding terminals, improving the common ground performance and the crosstalk of the electrical connector (or the transmission wafer) of the present disclosure.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A transmission wafer of an electrical connector, comprising:

an insulating frame;

a plurality of grounding terminals fixed to the insulating frame, wherein each of the grounding terminals includes a middle grounding segment embedded in the insulating frame, a front grounding segment, and a rear grounding segment, the latter two of which respectively extend from two ends of the middle grounding segment in two different directions; and a shielding member disposed on the insulating frame, wherein the shielding member includes a grounding sheet disposed on the insulating frame and a plurality of elastic arms curvedly extending from the grounding sheet to protrude from the insulating frame, and wherein the elastic arms are respectively abutted against portions of the front grounding segments arranged adjacent to the insulating frame.

2. The transmission wafer according to claim 1, wherein each of the front grounding segments includes a base portion abutted against the corresponding elastic arm and at least one contacting portion extending from the base portion in a direction away from the insulating frame, the insulating frame includes a plurality of grounding supports respectively corresponding in position to the elastic arms, and each of the elastic arms and the corresponding grounding support sandwich the base portion of one of the front grounding segments.

3. The transmission wafer according to claim 1, further comprising a plurality of signal terminals fixed to the insulating frame, wherein any two of the grounding terminals adjacent to each other are provided with two of the signal terminals there-between, wherein each of the signal terminals includes a middle signal segment embedded in the insulating frame, a front signal segment, and a rear signal segment, the latter two of which respectively extend from two ends of the middle signal segment in two different directions, and wherein the insulating frame includes a plurality pairs of signal supports, and each pair of the signal supports sandwiches a portion of one of the front signal segments arranged adjacent the insulating frame.

4. The transmission wafer according to claim 1, wherein the elastic arms include a plurality of narrow elastic arms and a broad elastic arm that is arranged at one side of the narrow elastic arms, and the broad elastic arm is farther away from the rear grounding segments than each of the narrow elastic arms.

5. The transmission wafer according to claim 4, wherein the insulating frame includes a plurality of rivets passing through and fixed onto the shielding member, and at least two of the rivets are arranged adjacent to at least two of the narrow elastic arms, respectively.

6. The transmission wafer according to claim 4, wherein the insulating frame includes a positioning block engaged with the shielding member and arranged adjacent to the broad elastic arm.

7. The transmission wafer according to claim 1, wherein the middle grounding segment of at least one of the grounding terminals has a plurality of thru-holes spaced apart from each other, and an inner wall defining one of the thru-holes has two protrusions facing each other, and wherein the shielding member includes a plurality of internally connecting arms respectively passing through the thru-holes, and at least one of the internally connecting arms is clamped between the two protrusions.

8. The transmission wafer according to claim 1, wherein each of the front grounding segments includes a base portion abutted against the corresponding elastic arm and at least one contacting portion extending from the base portion in a direction away from the insulating frame, and one of the elastic arms extends from the grounding sheet toward the base portion of the corresponding front grounding segment by being once bent.

9. The transmission wafer according to claim 1, wherein each of the front grounding segments includes a base portion abutted against the corresponding elastic arm and at least one contacting portion extending from the base portion in a direction away from the insulating frame, and one of the elastic arms extends from the grounding sheet toward the base portion of the corresponding front grounding segment by being twice bent respectively in two opposite directions.

10. An electrical connector, comprising:

a housing; and a plurality of the transmission wafers provided according to claim 1, wherein the transmission wafers are stacked in one pile and inserted into the housing.

11. The electrical connector according to claim 10, wherein the elastic arms of each of the transmission wafers includes a plurality of narrow elastic arms and a broad elastic arm that is arranged at one side of the narrow elastic arms, and wherein in two of the transmission wafers adjacent to each other, the two broad elastic arms are staggered to one another.

* * * * *